US007442105B2

(12) United States Patent
Russell et al.

(10) Patent No.: US 7,442,105 B2
(45) Date of Patent: Oct. 28, 2008

(54) PERSONAL VISIBILITY MARKER

(75) Inventors: Dianne M. Russell, Salem, NH (US); Robert J. Russell, Salem, NH (US); Joseph A. DiPalermo, Fremont, NH (US)

(73) Assignee: Freleng Safety Products, LLC, Salem, NH (US)

( * ) Notice: Subject to any disclaimer, the term of this patent is extended or adjusted under 35 U.S.C. 154(b) by 0 days.

(21) Appl. No.: 11/745,054

(22) Filed: May 7, 2007

(65) Prior Publication Data

US 2007/0287342 A1 Dec. 13, 2007

Related U.S. Application Data

(60) Provisional application No. 60/746,544, filed on May 5, 2006, provisional application No. 60/826,655, filed on Sep. 22, 2006.

(51) Int. Cl.
*B63C 9/08* (2006.01)

(52) U.S. Cl. ..... 441/89

(58) Field of Classification Search ..... 441/89
See application file for complete search history.

(56) References Cited

U.S. PATENT DOCUMENTS 4,035,856 A 7/1977 Oberg
4,464,129 A 8/1984 Vancheri et al.
4,598,661 A 7/1986 Roe
4,640,213 A 2/1987 Lugo
4,699,596 A 10/1987 Klinker et al.
4,713,896 A 12/1987 Jennens
4,850,908 A * 7/1989 Nakase et al. ..... 440/39
5,029,551 A 7/1991 Rosen
5,114,369 A 5/1992 Coffey
5,423,282 A 6/1995 Krull et al.
5,514,016 A 5/1996 Larson
5,516,233 A 5/1996 Courtney
5,651,711 A 7/1997 Samano
5,671,480 A 9/1997 Krout et al.
5,752,264 A 5/1998 Blake et al.
5,800,227 A 9/1998 Brown, Jr.

(Continued)

OTHER PUBLICATIONS

Chahine, Georges L. et al, "Cleaning and Cutting with Self-Resonating Pulsed Water Jets", Hydronautics, Inc., Laurel, Maryland, pp. 195-207.

(Continued)

*Primary Examiner*—Jesús D Sotelo
(74) *Attorney, Agent, or Firm*—Grossman Tucker Perreault & Pfleger, PLLC

(57) ABSTRACT

A personal visibility mark may increase the visibility of a person in the water to operators of watercraft or the like and may be used in combination with a personal floatation device. The personal visibility mark may include a housing including at least one intake opening. The housing may be removeably coupled to a personal floatation device or may be an integral component of the personal floatation device. A pump may be disposed within the housing and may be fluidly coupled to the intake opening and at least one nozzle for expelling a stream of water from the nozzle to increase the visibility of a user. The stream of water may include an interrupted stream. The interrupted stream may be provided by modulating the power to the pump and/or providing a self-resonating nozzle.

26 Claims, 7 Drawing Sheets

U.S. PATENT DOCUMENTS

| | | | |
|---|---|---|---|
| 5,855,454 | A | 1/1999 | Courtney et al. |
| 5,925,683 | A | 7/1999 | Park |
| 6,033,275 | A | 3/2000 | Ely |
| 6,160,025 | A | 12/2000 | Slaikeu et al. |
| 6,203,246 | B1 | 3/2001 | Courtney et al. |
| 6,289,840 | B1 | 9/2001 | Hill |
| 6,456,206 | B1 | 9/2002 | Rocca et al. |
| 6,527,479 | B1 | 3/2003 | Courtney et al. |
| 6,527,605 | B1 | 3/2003 | Charte |
| 6,530,725 | B1 | 3/2003 | Courtney et al. |
| 6,558,082 | B1 | 5/2003 | Courtney et al. |
| 6,659,689 | B1 | 12/2003 | Courtney et al. |
| 6,666,622 | B1 | 12/2003 | Courtney et al. |
| 6,786,784 | B2 | 9/2004 | Charte |
| 6,871,357 | B2 | 3/2005 | Herman et al. |

OTHER PUBLICATIONS

Johnson, Virgil E., et al, "Feasibility Study of Tuned-Resonator, Pulsating Cavitating Water Jet for Deep-Hole Drilling", Hydronautics, Inc., Laurel, Maryland, Aug. 1981, 1-146 total pages.

International Search Report and Written Opinion mailed on Jul. 3, 2008, received in corresponding PCT Application No. PCT/US07/68355.

* cited by examiner

PERSONAL VISIBILITY MARKER

CROSS REFERENCE TO RELATED APPLICATIONS

This application claims the benefit of U.S. Provisional Application No. 60/746,544 filed May 5, 2006 and U.S. Provisional Application No. 60/826,655 filed Sep. 22, 2006,both of which are fully incorporated herein by reference.

FIELD

The present disclosure generally relates to water safety devices, and more particularly to devices for increasing the visibility of a person in the water.

BACKGROUND

Many devices have been developed to improve the safety of individuals participating in water sports, or other activities in and around the water. Notably, the increasing development and use of personal floatation devices, such as life vests, etc., have had a significant impact on water safety. As is commonly understood, when the user of a personal floatation device is in the water, either through intentional entry, or by falling in, etc., a personal floatation device may maintain a user's head above the water. By maintaining the user's head above the water, a personal floatation device may significantly reduce incidents of drowning.

While a personal floatation device may reduce drowning risks, many waterborne activities carry other risks as well. Collisions between watercraft, such as boats, personal watercraft, etc., pose a serious danger. Activities such as the use of personal watercraft, water skiing, etc., may often involve repeated entries into the water by participants. For example, while the water skier is making a run, most of the water skier's body is above the water, and the skier can be easily seen by watercraft operators. However, if the water skier falls, only their head and a portion of their torso may be above the water, making it difficult for watercraft operators to identify and avoid the water skier. Such poor visibility may lead to collisions between watercraft and individuals in the water.

Personal floatation devices may be provided in bright colors, such as red, yellow, etc., in an attempt to increase the visibility of a user. While bright coloration is effective when the user is out of the water, by the nature of the device, when a user is in the water the majority of a personal floatation device is beneath the surface of the water, which reduces the effectiveness of any visibility enhancing coloration.

BRIEF DESCRIPTION OF THE DRAWINGS

Features and advantages of the present invention are set forth through the description of various embodiments consistent therewith, which description should be considered in combination with the accompanying drawings, wherein.

DETAILED DESCRIPTION

A personal visibility marker according to the present disclosure may increase the visibility of a person in the water to operators of watercraft, etc. A personal visibility marker herein may suitably be used by any participant in water activities, such as swimming, water skiing, tubing, wakeboarding, piloting a personal water craft, etc. Of course, a personal visibility marker according to the present disclosure may suitably be used in connection with any water activity. A personal visibility marker need not serve as a floatation device. In one aspect, the personal visibility marker may be used in combination with a personal floatation device. For example the personal visibility marker may be attached or secured to personal floatation device, such as a floatation vest, to make the user more visible to operators of watercraft, rescue personnel, and to other participants in water activities. In some embodiments, the personal visibility marker may require little or no participation by the user to activate or deploy the personal visibility marker.

Figure 1:
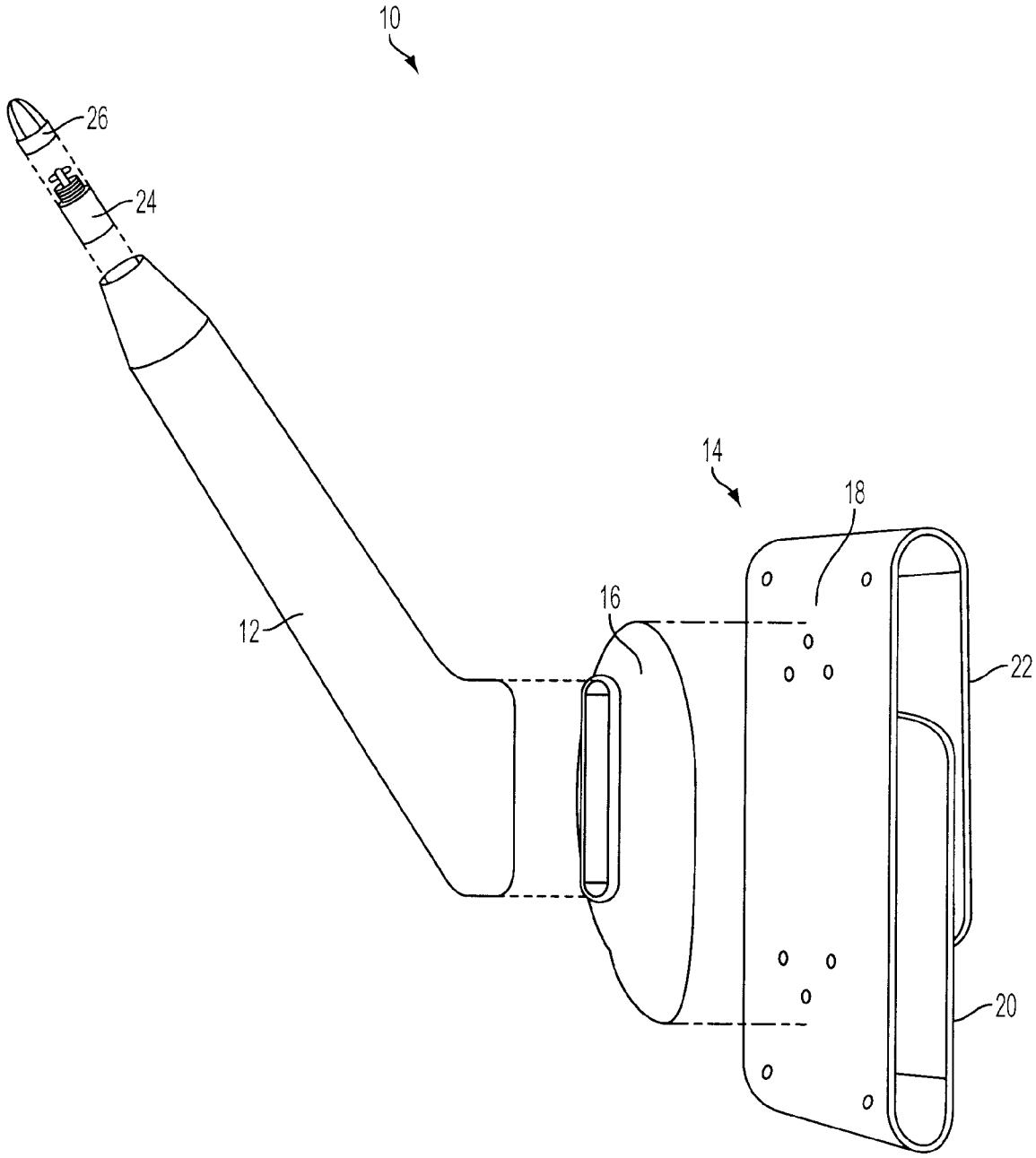
FIG. 1 is an exploded view of a first embodiment of a personal visibility marker consistent with the present disclosure.

Referring to FIG. 1, a first embodiment of a personal visibility marker 10 is shown. The personal visibility marker 10 may generally include a marker 12 which may be coupled to an attachment feature, such as a jacket strap 14. For example, the marker 12 may be coupled to the jacket strap 14 by a base 16. The base 16 may be attached to a mounting surface 18 of the jacket strap 14, e.g., using adhesives, mechanical fasteners, etc.

The jacket strap 14 may be configured to be secured to a personal floatation device, such as a life vest. The jacket strap 14 may be positioned on the back of a personal floatation device and respective strap portions 20, 22 may be positioned around the top and bottom of the back portion of the personal floatation device. The strap portions 20, 22 of the jacket strap 14 may be secured to one another on the inner surface of the back portion of the personal floatation device, thereby securing the marker 10 to the back of the personal floatation device. The strap portions 20, 22 may be secured to one another via hook and loop fasteners, buckles, etc.

The marker 12 may be flexible or resilient member, e.g., formed from a soft plastic or foam, which may be angled upwardly and outwardly from the base 16, such that the marker 12 may protrude above the surface of the water, e.g., by 24 inches, when the user is supported in the water by the personal floatation device. The marker 12 may be brightly colored, include reflective features, etc., to enhance passive visibility. When a user, having the personal visibility marker 10 attached to a personal floatation device, is in the water, the high visibility marker 12 may extend above the surface of the water, thereby increasing the visibility of the user.

In addition to passive visibility enhancing features, such as bright coloration and reflective features, the personal visibility marker 10 may include active visibility enhancing features. For example, as shown in FIG. 1, the personal visibility marker 10 may include a lighted beacon 24. The lighted beacon 24 may include one or more flashing LED's or lights and an associated battery pack. The LED's and battery pack may be commonly packaged, or may be provided as separate units. A lens cover 26 may be disposed over at least a portion of the beacon 24. The beacon 24 may be activated when the user is immersed in water, e.g., by a water or moisture activated switch (not shown) positioned below a waterline of the personal visibility marker 10. Alternatively, the beacon 24 may be manually activated prior to engaging in water activities and may be manually deactivated at the conclusion of the water activities.

Figure 2:
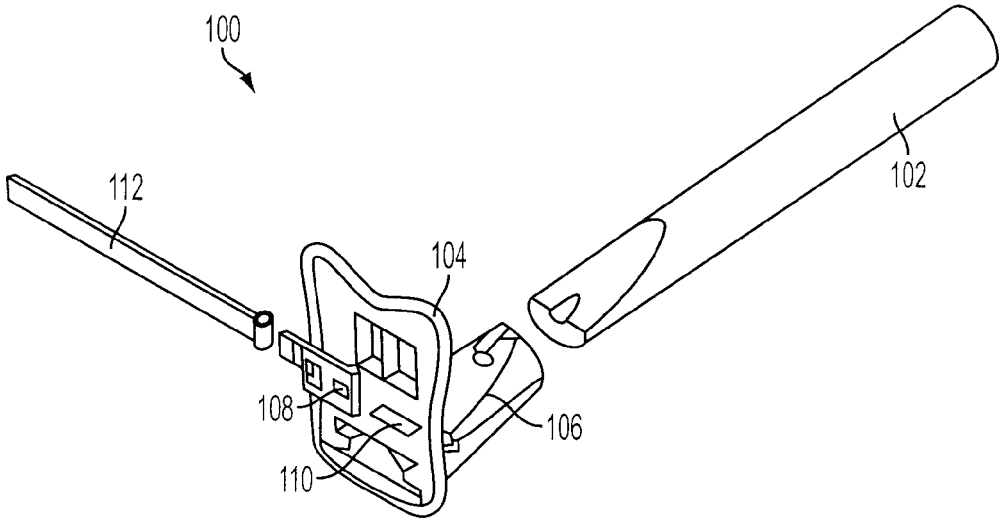
FIG. 2 is an exploded view of a second embodiment of a personal visibility marker consistent with the present disclosure.

Turning to FIG. 2, a second embodiment of a personal visibility marker 100 is shown. The personal visibility marker 100 may generally include a marker 102 which may be hingedly coupled to a base plate 104. The base plate 104 may, in turn, be coupled to a user's personal floatation device, e.g., using the jacket strap depicted with reference to the previous embodiment. The marker 102 may be hingedly coupled to the base plate 104 via a mounting cup 106. The base plate 104 and the mounting cup 106 may include cooperating hinge features allowing the cup 106, and the marker 102 therewith, to pivot relative to the base plate 104. The marker 102 may be coupled to the cup 106, e.g., by being at least partially received in a opening in the cup, via adhesive bonding, one or more fasteners, or the like. The marker 102 may also be formed as an integral unit with the cup 106.

The personal visibility marker 100 may be worn by a user, e.g., attached to the user's personal floatation device via a jacket strap. At least a portion of the marker 102 may include a buoyant member, such as a foam tube or cylinder, which may be maintained in a generally upright, stowed position, e.g., using a releasable catch 108. The releasable catch 108 may be configured to engage the cup 106 and to releasably retain the marker 102 positioned against the base plate 104. The catch 108 may be biased toward the latched position, e.g., via a spring 110.

The user may deploy the marker 102, e.g., when the user enters the water, by pulling the release strap 112, to release the catch 108 from engagement with the cup 106. Once released, the marker 102 may freely pivot relative to the base plate 104. The position of the marker 102 may be influenced by the buoyancy of the marker 102. For example, the buoyancy of the marker 102 may generally urge the marker 102 toward a generally upright position relative to the water. The generally upright position of the marker 102 relative to the water may maximize the extension of the marker 102 from the water, and provide improved visibility.

Release of the marker 102 for pivotal movement relative to the base plate 104 may be assisted by biasing the cup 106 out of engagement with the catch 108. For example, the hinged connection between the cup 106 and the base plate 104 may be spring loaded to urge the marker 102 pivotally away from the base plate 104. The biased release of the marker 102 may ensure that the marker 102 is released for pivotal movement relative to the base plate 104, e.g., in a situation in which the buoyancy of the marker 102 may resist separation of the cup 106 from the catch 108, for example, if the user is leaning slightly backwards during release.

The marker 102 may be returned to the stowed position by opening the catch 108, e.g., by pulling the release strap 112, and moving the marker 102 to a position generally parallel to the base plate 104. While the user is still in the water, this may conveniently be achieved by opening the catch 108 and leaning backward, such that the buoyancy of the marker 102 may urge the marker 102 to a position generally parallel to the base plate 104.

The marker 102 may be brightly colored, include reflective features, etc., to provide increased visibility. Additionally, similar to the previous embodiment, the marker may include a lighted beacon. The lighted beacon may include flashing lights, such as LED's, which may be manually activated by the user, or may be automatically activated when the user enters the water, e.g., by a water or moisture sensing switch.

Figure 3:
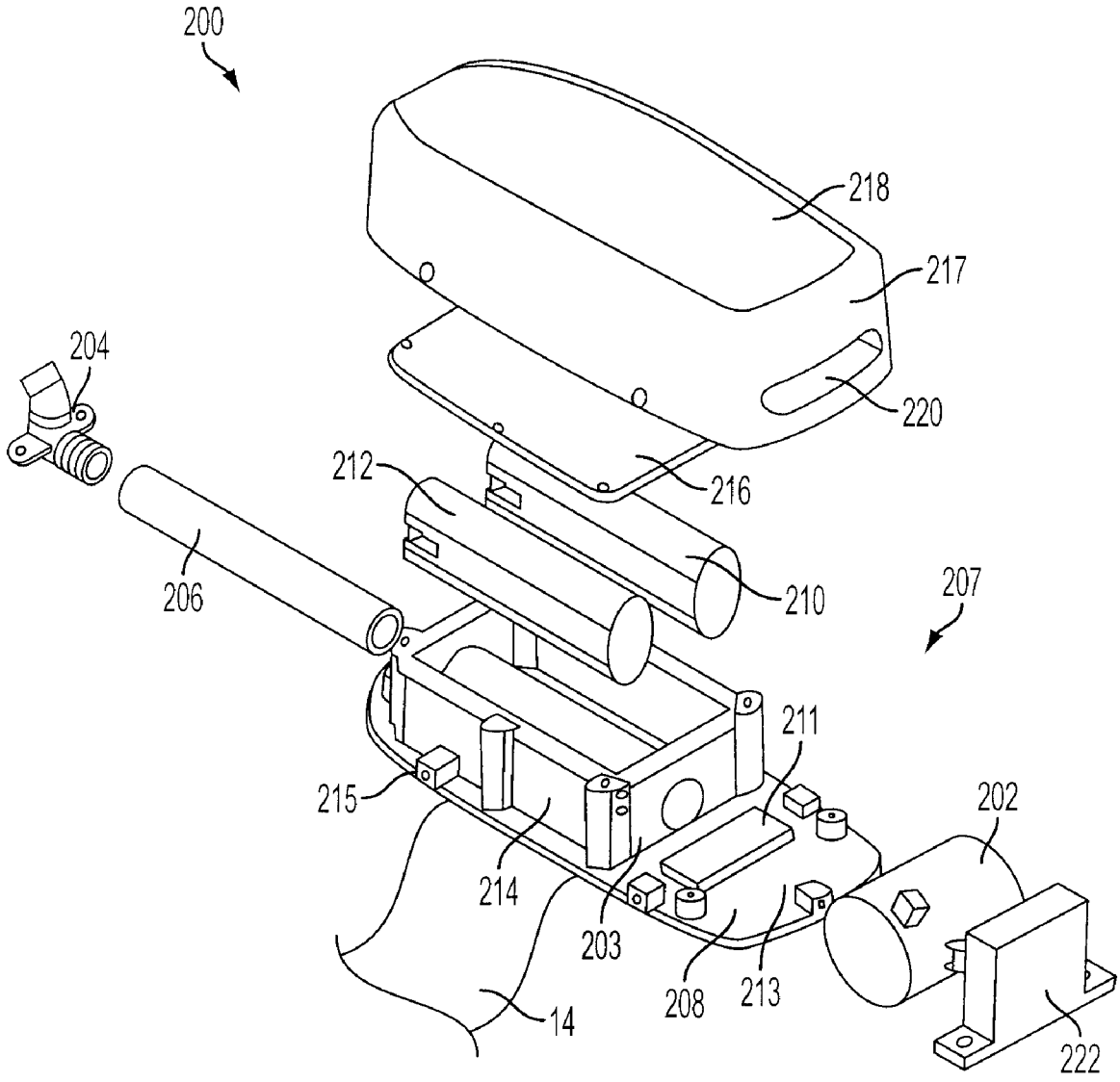
FIG. 3 is an exploded view of a third embodiment of a personal visibility marker consistent with the present disclosure.

Referring next to FIG. 3, yet another embodiment of a personal visibility marker 200 is shown. The personal visibility marker 200 may be coupled to a personal floatation device using one or more fasteners such as, but not limited to, a jacket strap 14 (only a portion of which is shown for clarity), adhesives, hook and loop type fasteners, buttons, clamps, or the like. At least a part of the personal visibility marker 200 may also be formed as a substantially integral feature of a personal floatation device as will be described below. The personal visibility marker 200 may generally include one or more pumps 202 for providing a jet or stream of water expelled from one or more nozzles 204. The pump 202 may be fluidly coupled to the nozzle 204, e.g., via one or more tubes, conduits, channels or the like 206, such that when at least a portion of the personal visibility marker 200 is in the water, the pump 202 may draw water from around the personal visibility marker 200 and expel one or more jets or streams of water from the nozzle 204 generally upwardly from the surface of the water.

The personal visibility marker 200 may also include a housing 207 including a base 208 and a cover 218 which may be configured to generally enclose one or more of the operative components of the personal visibility marker 200, thereby providing some degree of protection to these components. For example, the pump 202 and/or the nozzle 204 may be, either directly or indirectly, coupled to a base 208 of the housing 207. The housing 207 may include one or more openings 220 for providing an intake of water for the pump 202 and may define one or more fluid conduits or passageways 203 coupled to the pump 202. The fluid conduits 203 may be fluidly coupled to the tube 206 and nozzle 204. The tube 206 may be formed as an integral element of the housing 207 or as a separate component configured to be coupled to the housing 207. One or more openings 220 may be provided in the housing 207 to allow water to be drawn into the pump 202. According to one embodiment, the opening 220 may be provided in the cover 218. The opening 220 may also be provided with a filter, screen or grate 217 to reduce and/or prevent debris from clogging the pump 202 and/or reduce the possibility of injury to others. Of course, various alternative configurations may be provided for fluidly coupling the pump 202 to the water adjacent to the personal visibility marker 200 and for fluidly coupling the pump 202 to a nozzle 204 for dispensing a stream or jet of water.

The pump 202 may be of any suitable variety, e.g., centrifugal, impeller, vane, etc. The pump 202 may include any pump 202 cable of providing sufficient flow rate and/or head to create a stream of water from the nozzle 204 sufficient to increase the visibility of the user while in the water. For example, the pump 202 may be configured to provide a flow rate between approximately 400 gph to approximately 800 gph and may provide a head between approximately 8 feet to approximately 20 feet or between approximately 9 feet to approximately 15 feet.

The pump 202 may be powered by one or more batteries 210, 212, and/or other suitable power supply (for example, but not limited to, one or more solar power panels or the like), which may be rechargeable or non-rechargeable. For example, batteries 210, 212 may include, but are not limited to, rechargeable lithium ion batteries configured to provide a voltage of between approximately 12 to approximately 20 volts and provide a current of between approximately 2.00 to approximately 4.00 amps to the pump 202. In one exemplary embodiment, the batteries 210, 212 may provide a voltage of approximately 18 volts and a current of approximately 2.22 amps.

The batteries 210, 212 may be at least partially disposed in a battery housing 214, which may be coupled to or integrally formed with housing 207, for example the base 208. The battery housing 214 may include a cover 216, which may sealingly engage the housing 214 to reduce and/or prevent the ingress of water. According to one embodiment, the batteries 210, 212 may be accessible for user replacement. The battery housing 213 may also include an electrical connector 215 for connecting a battery charger to the batteries 210, 212. The use of an electrical connector 215 may allow the batteries 210, 212 to be recharged without having to remove the batteries 210, 212 from the battery housing 214.

The batteries 210, 212 may be provided in close proximity to the pump 202, however, the batteries 210, 212 may also be provided virtually anywhere within the personal visibility marker 200 and/or the personal floatation device. For example, the batteries 210, 212 may be provided in a battery housing 214 which is separate from the base 208 and which may be configured to be electrically coupled to the pump 202. The battery housing 214 may be configured to be coupled directly to a personal floatation device in a location which is remotely located from the housing 207 or base 208. The location of the batteries 210, 212 may be selected to reduce or minimize restriction of the fluid flow through the personal visibility marker 200, reduce the overall size of the personal visibility marker 200, and/or provide increased comfort for the user.

The personal visibility marker 200 may also include one or more switches 222 provided to activate and/or deactivate the personal visibility marker 200. The switch 222 may include a water or moisture sensitive switch, a float-type switch, or the like, which may turn the pump 202 on when the switch 222 senses water and/or is immersed in water, e.g., when the user enters the water. The switch 222 may be located anywhere on the personal visibility marker 200 and/or the personal floatation device. In accordance with one embodiment, the switch 222 may be positioned substantially adjacent to the opening 220 in the housing 207. Providing the switch 222 substantially adjacent to the opening 220 in the housing 207 may reduce the possibility of the pump 202 being activated when the opening 220 is not submerged. According to another embodiment, the switch 222 may include an on/off switch or the like which may be manually operated.

The personal visibility marker 200 may optionally include a control circuit 211 that may regulate the power to the pump 202. The control circuit 211 may be coupled to the switch 222 and/or the batteries 210, 212. For example, the control circuit 211 may receive a signal from the switch 222 and may regulate the power from the batteries 210, 212 to the pump 202. The control circuit 211 may also receive a signal from one or more additional sensors and/or switches 213 such as, but not limited to, an orientation sensor or the like which may detect the orientation of the personal visibility marker 200. For example, the control circuit 211 may receive a signal from an orientation and/or position sensor 213 (e.g., a mercury switch, gyroscopic sensor, or the like) which is indicative of the personal visibility marker 200 being upside down and may also receive a signal from the switch 222 indicative of the personal visibility marker 200 being immersed in the water. In this case, the control circuit 211 may not activate the pump 202 until the personal visibility marker 200 is generally upright in order to conserve power of the batteries 210, 212. Additionally, the control circuit 211 may receive a signal from a timer (which may be activated upon the switch 222 sensing that the personal visibility marker 200 is immersed), may receive a signal indicative of the remaining power of the batteries 210, 212 to prevent damage to the batteries 210, 212, and/or may receive a signal indicative of a inlet and/or outlet water pressure within the personal visibility marker 200 to prevent damage to the pump 202 in the event of a blockage or restriction.

The control circuit 211 may place the personal visibility marker 200 in a standby mode of operation when the user engages in waterborne activities. In the event that the user enters the water, the control circuit 211 may activate the personal visibility marker 200 (e.g., after having received an appropriate signal from the switch 222) to provide power to the pump 202 and produce a stream of water that may be directed generally upwardly from the surface of the water. The stream of water may increase the visibility of the user.

The control circuit 211 may also be configured to provide an intermittent, pulsating, or interrupted stream or "slugs" of water exiting from the nozzle 204. For example, the control circuit 211 may be configured to modulate the power to the pump 202 to result in an intermittent, pulsating, or interrupted stream of water exiting from the nozzle 204. The control circuit 211 may also be configured to send one or more signals to a transducer (for example, but not limited to, a piezoelectric transducer) and/or one or more rotating slotted rotors, disks, or sprockets disposed in the fluid passageway. The intermittent, pulsating, or interrupted stream or "slugs" of water exiting from the nozzle 204 may increase the visibility of the personal visibility marker 200 (and therefore increase the safety of the personal visibility marker 200) compared to a solid stream of water.

The overall safety of the personal visibility marker 200 may also be enhanced by lighting the stream of water emitted from the nozzle 204. For example, the control circuit 211 may activate one or more lights (e.g., LED's which may be disposed in or around the nozzle 204) upon receiving one or more signals from the switch 222 and/or the sensors 213. The stream of water from the nozzle 204 may function similar to a light pipe. In this manner, at least a portion of the stream of water may be illuminated or colored by the light. Illumination of the water stream may be increased by providing the water stream as a frothing, turbulent stream of water, thereby providing increased light dispersion.

The nozzle 204 may include any nozzle design capable of providing a stream of water at a height above the user sufficient to increase the visibility of the user. For example, the nozzle 204 may be configured (along with the pump 202) to provide a stream of water approximately 9 to approximately 15 feet or approximately 9 to approximately 12 feet above the nozzle 204. As discussed above, the nozzle 204 may also include one or more light emitters (such as, but not limited to, one or more LEDs) configured to at least partially illuminate the stream of water exiting from the nozzle 204. The nozzle 204 may also be configured to create a frothing, turbulent stream of water. The frothing, turbulent stream of water may further enhance the visibility of the stream of water by increasing light scattering and/or dispersion. As discussed above, this frothing, turbulent stream of water may optionally be at least partially illuminated thereby further increasing the visibility of the stream of water.

Figure 4A:
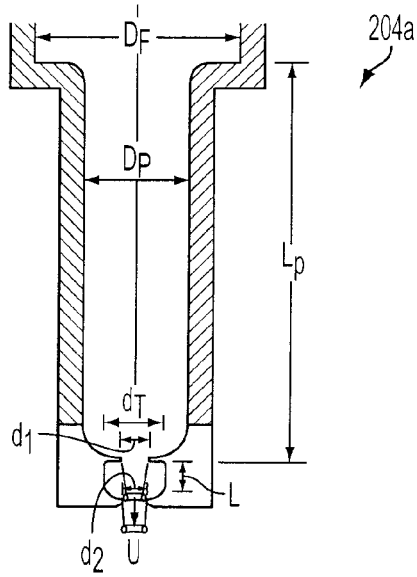
FIG. 4 are perspective views of various embodiments of self resonating nozzles consistent with the present disclosure.
Figure 4B:
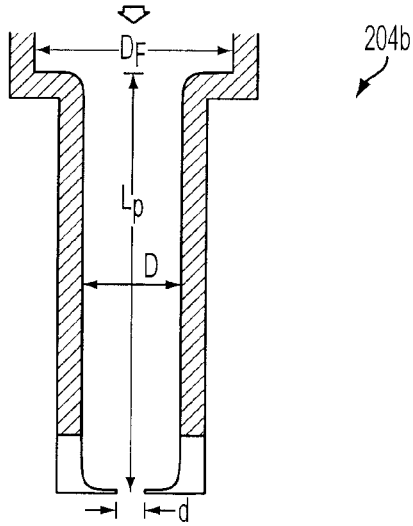
Figure 4C:
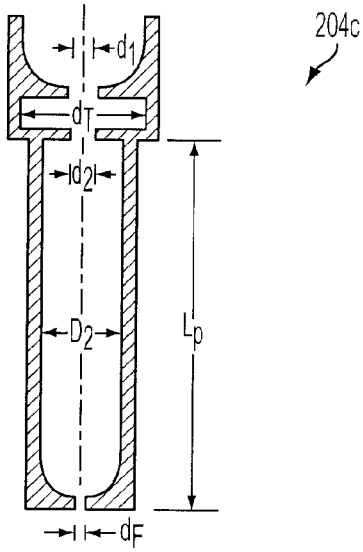

According to one embodiment, the nozzle 204 may be configured to provide an intermittent, pulsating, or interrupted stream or "slugs" of water. For example, the nozzle 204 may include a mechanical nozzle (such as, but not limited to, a flapper valve type nozzle) which may be configured to at least momentarily partially restrict the flow of water through the nozzle 204. The nozzle 204, FIGS. 4, may also include a self-resonating nozzle. The self-resonating nozzle 204 may include one or more internal cavities and outlet orifices configured to induce cyclical disturbances and/or oscillating flow within the nozzle 204. For example, a self-resonating nozzle 204 may include, but is not limited to, a "pulser" type nozzle 204*a* (FIG. 4*a*), an "organ-pipe" type nozzle 204*b* (FIG. 4*b*), and/or a "pulser-fed" type nozzle 204*c* (FIG. 4*c*). Of course, various alternative configurations of the nozzle 204 may be provided for providing an intermittent, pulsating, or interrupted stream or "slugs" of water. Those skilled in the art will recognize that the specific dimensions of the nozzle 204 will depend upon the intended application, the flow rate and maximum head of the pump 202, and the like.

Figure 5:
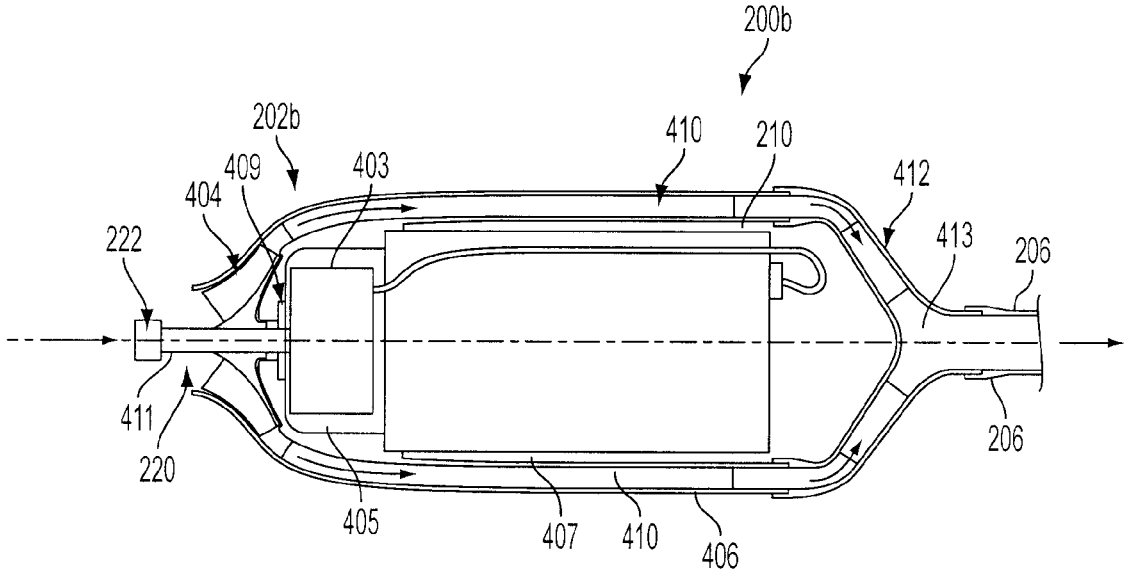
FIG. 5 is a perspective view of one embodiment of a personal visibility marker consistent with the present disclosure.

Referring to FIG. 5, one embodiment of a personal visibility marker 200*b* consistent with the present disclosure is shown. The personal visibility marker 200*b* may include a pump 202*b* configured to be electrically coupled to one or more batteries 210. The pump 202*b* may include a motor 403 and an impeller 404. The impeller 404 may be directly coupled to the motor 403 or indirectly coupled to the motor 403 (for example, but not limited to, by a one or more gears, pulley, or the like). The pump 202*b* and the impeller 404 may be configured to provide a flow rate between approximately 400 gph to approximately 500 gph and may provide a head between approximately 9 feet to approximately 15 feet or between approximately 9 feet to approximately 12 feet.

The motor 403 may utilize approximately 40 watts at the operating point and may be rated between approximately 12 to approximately 18 volts and between approximately 2 to approximately 3.33 amps. The motor 403 may include a no load speed of approximately 5940 rpm and an operating rotational speed of approximately 3600 rpm to approximately 8500 rpm. According to one embodiment, the motor 403 may include a 40 watt motor rated at 18 volts and 2.22 amps at 6000 rpm.

The impeller 404 may have an OD of between approximately 1.250 inches to approximately 2.370 and may have an impeller exit blade height of between approximately 0.095 to approximately 0.200 inches. According to one embodiment, the impeller 404 may have an OD of approximately 1.250 inches and an exit blade height of approximately 0.128. Other dimensions within or outside of these ranges are also possible.

The pump 202*b* may include a housing 406 configured to at least partially receive the motor 403 and batteries 210. The housing 406 may be an integral component of the housing 207 described above, may be coupled (either directly or indirectly) to the housing 207, or may be a separate feature from the housing 207. For example, the housing 406 may include one or more chambers or receptacles 405, 407 configured to accept the motor 403 and/or the batteries 210. The motor chamber 405 may be provided with one or more fastening features to secure the motor 403 to the housing 406 and one or more seals 409 for reducing or preventing water from entering around the shaft 411 coupled to the impeller 404. As discussed above, the battery chamber 407 may include a removable cover, lid, or cap 412 which may provide access to the batteries 210 for removal thereof.

The housing 406 may also include one or more openings 220 providing an intake of water for the pump 202*b*. The impeller 404 may be disposed proximate the opening 220 for drawing in water from the outside and may discharge the water into one or more channels or flow guide vanes 410 disposed within the housing 406. For example, one or more flow channels 410 may be disposed about one or more sides of the motor 403 and batteries 210. The flow channels 410 may be provided on only a single side of the motor 403 and/or batteries 210 or one multiple sides of the motor 403 and/or batteries 210. In one embodiment, two flow channels 410 may be provided about a first and second generally opposite side of the motor 403 and/or batteries 210 which may join at an intersection 413. A portion of the flow channels 410 (for example, the intersection 413) may be provided in a removable cap or cover 412 which may be configured to be fluidly coupled to the nozzle (not shown). A benefit of this design is that it may reduce the complexity of manufacturing the pump 202*b* compared to the pumps described herein. As a result, the pump 202*b* may be useful in a wider range of applications where cost is a limiting factor.

Figure 6:
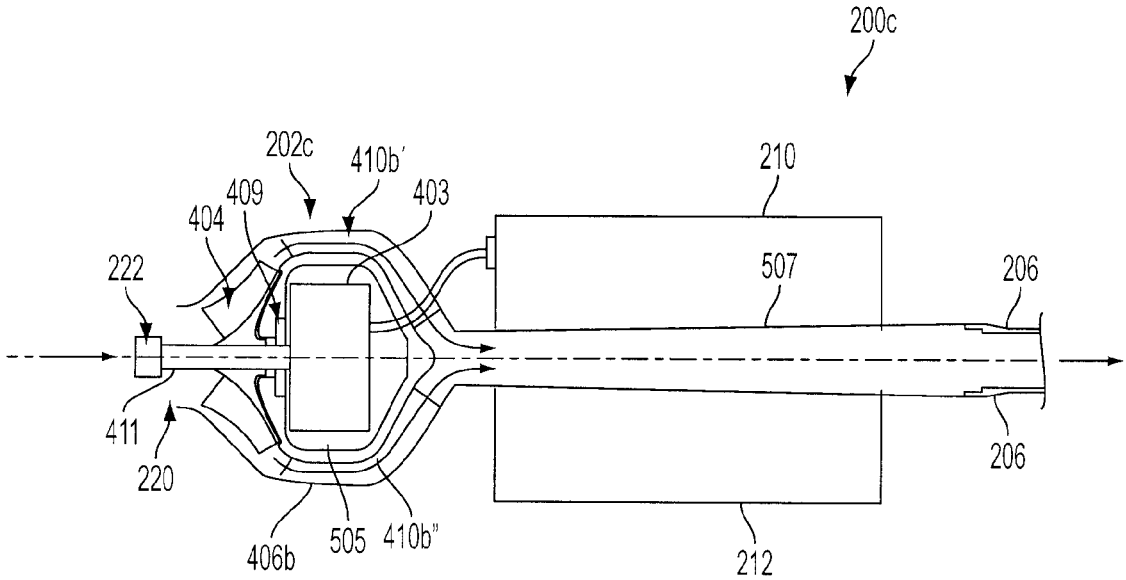
FIG. 6 is a perspective view of another embodiment of a personal visibility marker consistent with the present disclosure.

Referring to FIG. 6, another embodiment of a personal visibility marker 200*c* consistent with the present disclosure is shown. The personal visibility marker 200*c* may include a pump 202*c* configured to be electrically coupled to two or more batteries 210, 212. The pump 202*c* may include a motor 403 and an impeller 404 as generally described above. The pump 202*c* may include a housing 406*b* configured to at least partially receive the motor 403 and batteries 210, 212. For example, the housing 406*b* may include a first chamber or receptacle 505 configured to accept the motor 403. The housing 406*b* may optionally include a second chamber or receptacle 407 configured to accept the batteries 210, 212, however, the batteries 210, 212 may be disposed in a separate receptacle 407 remotely located from the pump 202*c*. The motor chamber 505 may be provided with one or more fastening features to secure the motor 403 to the housing 406*b* and one or more seals 409 for reducing or preventing water from entering around the shaft 411 coupled to the impeller 404.

The housing 406*b* may also include an opening 220 providing an intake of water for the pump 202*c*. The impeller 404 may be disposed proximate the opening 220 for drawing in water from the outside and may discharge the water into one or more channels or flow guide vanes 410*b* disposed within the housing 406*b*. For example, one or more flow channels 410*b* may be disposed about one or more sides of the motor 403. The flow channels 410*b* may be provided on only a single side of the motor 403 or one multiple sides of the motor 403. In one embodiment, two flow channels 410*b*', 410*b*" may be provided about a first and second generally opposite side of the motor 403 which may join at an intersection 413 after the motor 403. A portion 507 of the flow channels 410*b* may be configured to flow between two or more of the batteries 210, 212 which may be provided in the housing 406*b*. A benefit of this design is that it may reduce the overall dimensions of the pump 202*c* compared to the pumps described above. As a result, the pump 202*c* may be useful in a wider range of applications where package size is a limiting factor.

Figure 7:
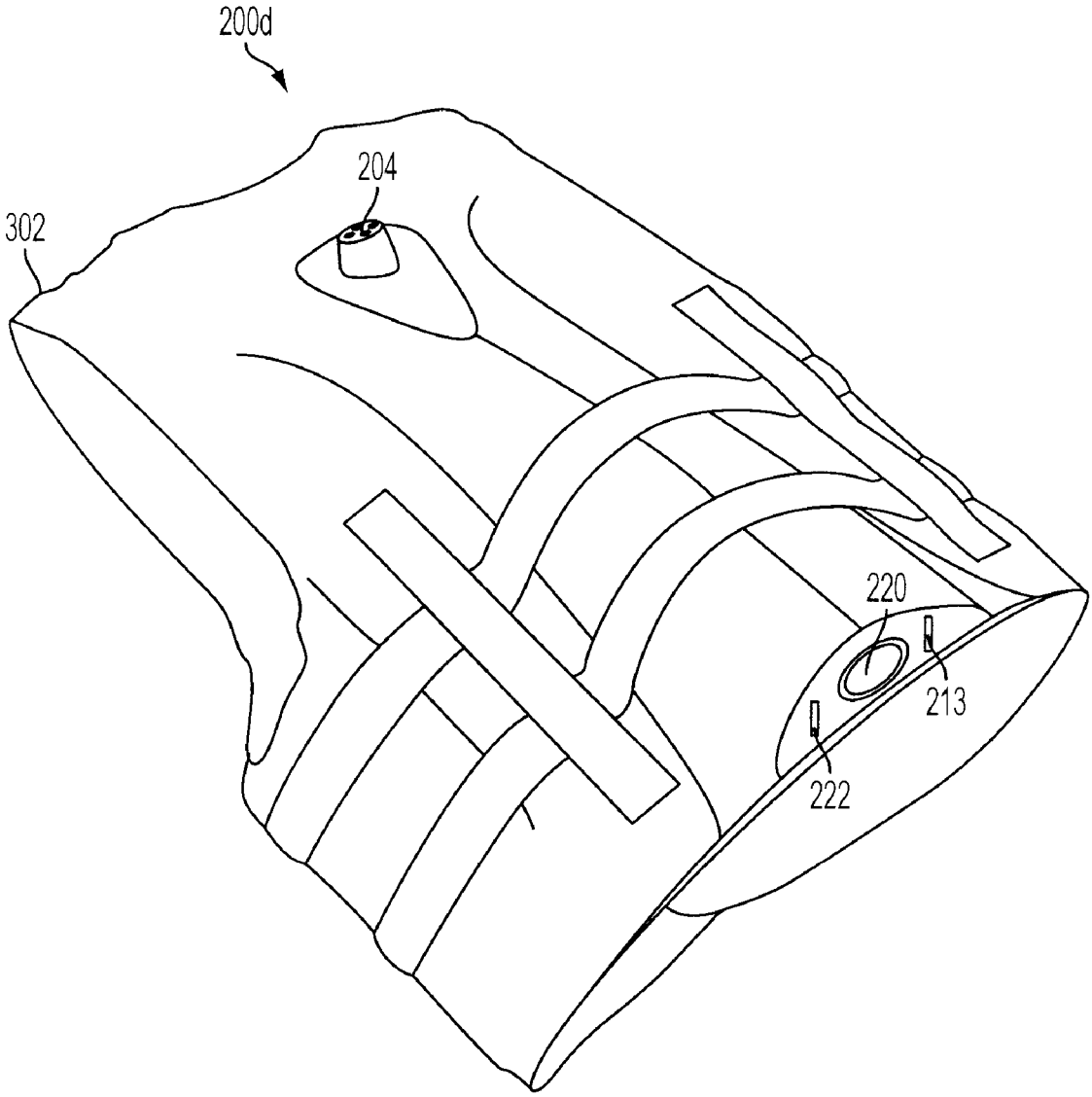
FIG. 7 is a perspective view of yet another embodiment of a personal visibility marker consistent with the present disclosure.
Figure 8:
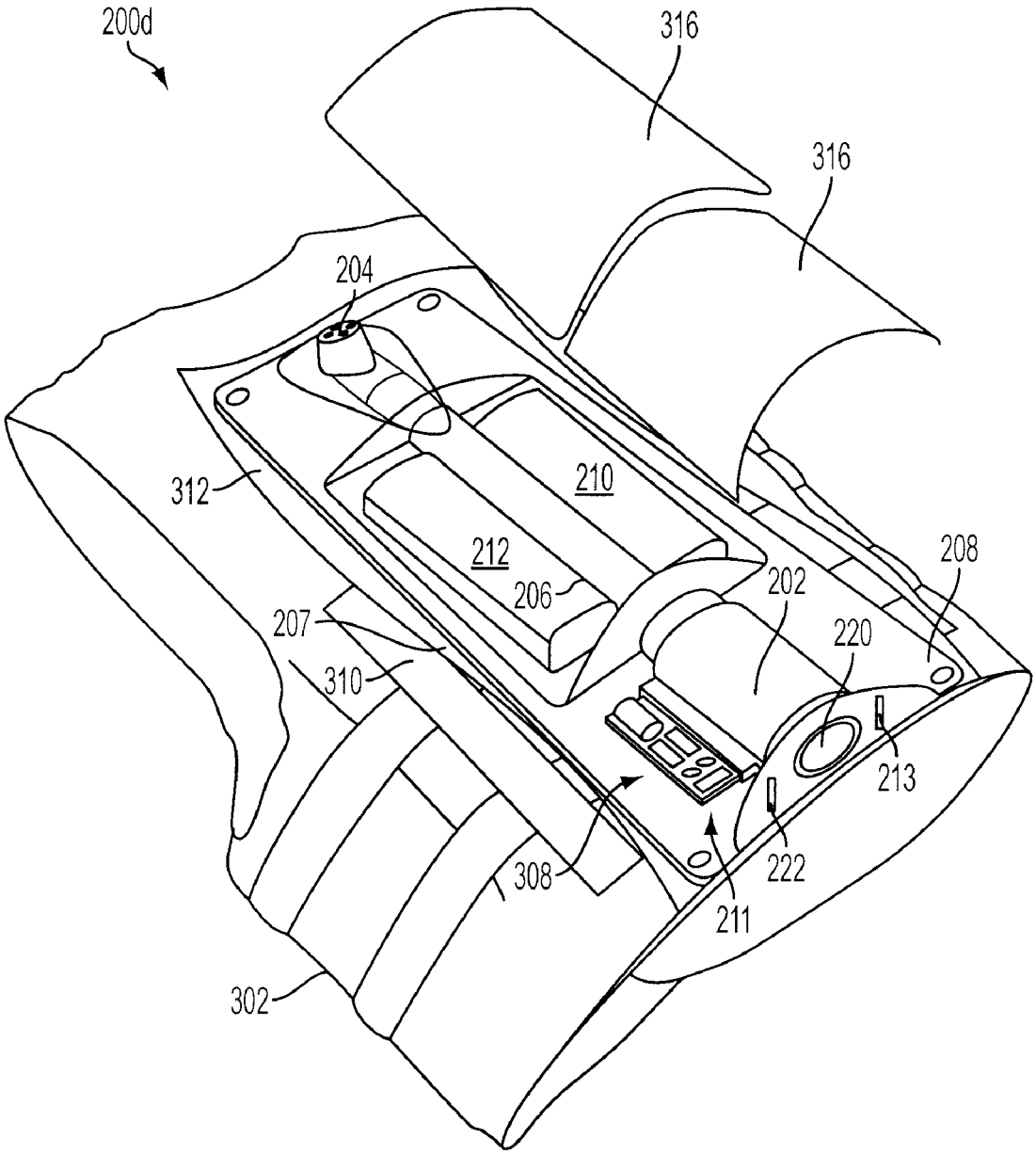
FIG. 8 is a partial exploded view of the personal visibility marker of FIG. 7 consistent with the present disclosure.

Referring to FIGS. 7 and 8, an embodiment of a personal visibility marker 200*d* may be incorporated into, or at least partially contained within, a personal floatation device 302. As shown, the personal floatation device 302 may be a life-jacket type personal floatation device, although a personal visibility marker may be incorporated into various other personal floatation device configurations, such as horseshoe style devices, etc. The personal visibility marker 200*d* may be configured to expel a jet or stream of water, e.g., generally upwardly into the air, to mark the location of the user in the water. For example, the personal visibility marker 200*d* may include a water intake 220 for drawing water from around the user, and an exit nozzle 204 through which the stream or jet of water may be expelled. In various other embodiments, the personal visibility marker 200*d* may include a personal floatation device 302 having a stationary or a deployable marker 200*d*, consistent with any embodiment herein, coupled to the personal floatation device 302.

Referring also to FIG. 8, a partial exploded view of an embodiment of a personal visibility marker 200*d* configured to expel a stream or jet of water is shown. The water intake 220 may be coupled to a pump 202 for supplying water to the pump 202, e.g., when the user is at least partially immersed, etc. According to one embodiment, the water intake 220 may be provided proximate the bottom of the personal floatation device 302 to ensure that the water intake 220 will be submerged when the user is in the water. The pump 202 may, in turn, deliver water through one or more tubes 206 to the nozzle 204 for producing a stream or jet of water. The pump 202 may be powered by one or more batteries 210, 212, or other suitable power supply, which may be rechargeable or non-rechargeable batteries. In some embodiments, the batteries 210, 212 may be accessible for user replacement.

Operation of the personal visibility marker 200*d* may be controlled by control electronics 211, which may, for example, be coupled to one or more sensors (for example, but not limited to, switch 222 and/or sensor 213 described above). For example, sensors 222, 213 may indicate that the user is at least partially immersed in water and the control electronics 211 may power the pump 202 to produce a jet or stream of water expelled from the nozzle 204. The sensors 222, 213 may also include an orientation or position sensor and/or switch. The personal floatation device 302 may define one or more cavities 308, 310, 312 configured to receive one or more components of the personal visibility marker 200*d*. For example, the cavities 308, 310, 312 may include one or more cover portions 316 which may at least partially overly one or more of the components of the personal visibility marker 200*d* (for example, but not limited to, the housing 207, the pump 202, batteries 210, 212, control electronics 211, or the like). The cover portions 316 may be removable or non-removable members which may cooperate with various other features to provide various desired levels of protection, e.g., in a generally water tight condition.

As shown, the various components of the personal visibility marker 200*d*, e.g., the intake 220, nozzle 204, pump 202, power supply 210, 212, control electronics 211, and sensors 222, 213, which may generally make up a personal visibility marker assembly 200*d*, may generally be disposed on, or at least partially contained in, a lifejacket 302. The components of the personal visibility marker 200*d* need not be grouped together, e.g., on the back panel of the lifejacket 302, but may instead be located around the lifejacket 302, e.g., to provide altered weight distribution, floatation characteristics, comfort, etc. Additionally, the various components of the personal visibility marker 200*d* may be fully integrated into the personal floatation device 302. However, in various alternative embodiments, the components may be provided in a housing or packaging mounted on the personal floatation device 302, either removably or non-removably. Various other configurations will also be readily apparent.

Various other embodiments may include, for example, combinations of the features of the illustrated exemplary embodiments. For example, a personal visibility marker may include fixed or pivoting marker configured to extend above the surface of the water when a user supported in the water by a personal floatation device. The personal visibility marker may also include a pump and nozzle for expelling a stream of water from the top fixed or pivoting marker. Various other embodiments are also contemplated herein.

According to one aspect, the present disclosure provides an arrangement for attaching or securing a feature or device, such as a personal visibility marker, storage pack, etc., to a personal floatation device. The arrangement may generally include a strap configured to loop around at least a portion of a panel, e.g., the back, of a personal floatation device. The strap may be adjustable and removable, e.g., through the use of hook and loop fasteners, buckles, etc.

According to another aspect, the present disclosure may provide a personal visibility marker including a high visibility marker that is adapted to be secured to the back of a personal floatation device. The visibility marker may be maintained in a fixed position relative to the personal floatation device. For example, the visibility marker may be arranged to extend generally upwardly from the surface of the water when a user is supported in the water by the personal floatation device.

According to another aspect, the present disclosure may provide a personal visibility marker including a high visibility marker that is adapted to be secured to a personal floatation device and to have a variable orientation relative to the personal floatation device. For example, the visibility marker may be pivotally coupled to the personal floatation device. The orientation of the visibility marker may, at least in part, be based on the buoyancy of the marker.

According to yet another aspect, the present disclosure may provide a personal visibility marker configured to produce a jet of water extending generally upwardly from a user supported in the water by a personal floatation device. The personal visibility marker system may include a battery powered pump which may expel a stream of water from a nozzle.

According to still a further aspect, the present disclosure may provide a personal visibility marker which may be coupled to, or incorporated as part of, a personal floatation device. In one embodiment, a personal floatation device may include a pump and power supply for drawing water from around a user through an intake and expelling a stream or jet of water from a nozzle to increase the visibility of the user. The personal floatation device may also include various associated control electronics, sensors, etc. capable of controlling the operation of the personal visibility marker.

In another embodiment, the present disclosure may feature a personal visibility marker comprising a housing configured to be coupled to a personal floatation device and including at least one intake opening. A pump may be coupled to the housing and fluidly coupled to the intake opening. The personal visibility marker may also include a power supply configured to be coupled to the pump and at least one nozzle fluidly coupled to the pump. The nozzle may be configured to expel a stream of water to increase the visibility of a user.

In a further embodiment, the present disclosure may feature a floatation system comprising a personal floatation device defining at least one cavity and a personal visibility marker. The personal visibility marker may comprise a housing configured to be at least partially disposed within the cavity of the personal floatation device and may include at least one intake opening. A pump may be coupled to the housing and fluidly coupled to the intake opening. One or more switches may be configured to provide power to the pump when the opening is immersed in water. At least one nozzle may be fluidly coupled to the pump and configured to expel a stream of water generally upwardly to increase the visibility of a user.

In yet another embodiment, the present disclosure may feature a personal visibility marker comprising a housing including at least one intake opening and a pump coupled to the housing and fluidly coupled to the intake opening. At least one switch may be configured to provide power to the pump when the opening is immersed in water for providing water to at least one nozzle fluidly configured to expel a stream of water to increase the visibility of a user. At least one fastener may be configured to removably couple the housing to a personal floatation device.

The features and aspects described with reference to particular embodiments disclosed herein may be susceptible to combination and/or application in various other embodiments described herein. Such combinations and/or applications of such described features and aspects to such other embodiments are contemplated herein. Additionally, the embodiments disclosed herein are susceptible to numerous variations and modifications without materially departing from the spirit of the disclosed subject matter. Accordingly, the invention herein should not be considered to be limited to the particular embodiments disclosed herein.

The invention claimed is:

1. A personal visibility marker comprising:

a housing including at least one intake opening, said housing configured to be coupled to a personal floatation device;

a pump coupled to said housing and fluidly coupled to said at least one intake opening;

a power supply configured to be coupled to said pump;

at least one switch configured to provide power to said pump when said at least one opening is immersed in water; and at least one nozzle fluidly coupled to said pump, said nozzle configured to expel a stream of water to increase the visibility of a user.

2. The personal visibility marker of claim 1 wherein said housing comprises a base and a cover configured to be secured to said base, wherein said pump is configured to be coupled to said base.

3. The personal visibility marker of claim 2 wherein said cover comprises said at least one intake opening.

4. The personal visibility marker of claim 1 wherein said at least one intake opening further includes at least one screen.

5. The personal visibility marker of claim 1 wherein said power supply comprises at least one battery configured to be received in at least one battery housing.

6. The personal visibility marker of claim 5 wherein said at least one battery housing is coupled to said housing.

7. The personal visibility marker of claim 5 wherein said at least one battery housing is configured to be coupled to said personal floatation device remotely from said housing.

8. The personal visibility marker of claim 1 wherein said nozzle is configured to provide a generally turbulent stream of water.

9. The personal visibility marker of claim 8 further comprising at least one light source configured to at least partially illuminate said generally turbulent stream of water.

10. The personal visibility marker of claim 1 wherein said nozzle is configured to provide an interrupted stream of water.

11. The personal visibility marker of claim 10 wherein said nozzle includes a self resonating nozzle.

12. The personal visibility marker of claim 1 further comprising a control circuit configured to control power to said pump.

13. The personal visibility marker of claim 12 wherein said control circuit is further configured to modulate power to said pump to provide an interrupted stream of water.

14. The personal visibility marker of claim 1 further comprising at least one strap configured to removably couple said housing to said personal floatation device.

15. The personal visibility marker of claim 1 wherein said personal floatation device includes at least one cavity configured to receive said housing.

16. A floatation system comprising:

a personal floatation device defining at least one cavity; and a personal visibility marker comprising:

a housing configured to be at least partially disposed within said at least one cavity of said personal floatation device, said housing including at least one intake opening;

a pump coupled to said housing and fluidly coupled to said at least one intake opening;

at least one switch configured to provide power to said pump when said at least one opening is immersed in water;

at least one nozzle fluidly coupled to said pump, said nozzle configured to expel a stream of water generally upwardly to increase the visibility of a user; and a control circuit configured to modulate power to said pump to provide an interrupted stream of water.

17. The floatation system of claim 16 wherein said nozzle is configured to provide an interrupted stream of water.

18. A floatation system comprising:

a personal floatation device defining at least one cavity; and a personal visibility marker comprising:

a housing configured to be at least partially disposed within said at least one cavity of said personal floatation device, said housing including at least one intake opening;

a pump coupled to said housing and fluidly coupled to said at least one intake opening;

at least one switch configured to provide power to said pump when said at least one opening is immersed in water; and at least one nozzle fluidly coupled to said pump, said nozzle configured to expel a stream of water generally upwardly to increase the visibility of a user, wherein said nozzle includes a self-resonating nozzle configured to provide an interrupted stream of water.

19. A personal visibility marker comprising:

a housing including at least one intake opening;

a pump coupled to said housing and fluidly coupled to said at least one intake opening;

at least one switch configured to provide power to said pump when said at least one opening is immersed in water;

at least one nozzle fluidly coupled to said pump, said nozzle configured to expel a stream of water to increase the visibility of a user;

at least one fastener configured to removably couple said housing to a personal floatation device; and a control circuit configured to modulate power to said pump to provide an interrupted stream of water.

20. The personal visibility marker of claim 19 wherein said at least one fastener includes at least one strap.

21. The personal visibility marker of claim 19 wherein said nozzle is configured to provide an interrupted stream of water.

22. A personal visibility marker comprising:

a housing including at least one intake opening;

a pump coupled to said housing and fluidly coupled to said at least one intake opening;

at least one switch configured to provide power to said pump when said at least one opening is immersed in water;

at least one nozzle fluidly coupled to said pump, said nozzle configured to expel a stream of water to increase the visibility of a user; wherein said nozzle includes a self-resonating nozzle configured to provide in interrupted stream of water; and at least one fastener configured to removably couple said housing to a personal floatation device.

23. A personal visibility marker further comprising:

a housing including at least one intake opening, said housing configured to be coupled to a personal floatation device;

a pump coupled to said housing and fluidly coupled to said at least one intake opening;

a power supply configured to be coupled to said pump;

at least one nozzle fluidly coupled to said pump, said nozzle configured to expel a stream of water to increase the visibility of a user, wherein said nozzle is configured to provide a generally turbulent stream of water; and at least one light source configured to at least partially illuminate said generally turbulent stream of water.

24. A personal visibility marker comprising:

a housing including at least one intake opening, said housing configured to be coupled to a personal floatation device;

a pump coupled to said housing and fluidly coupled to said at least one intake opening;

a power supply configured to be coupled to said pump; and at least one nozzle fluidly coupled to said pump, said nozzle configured to expel a stream of water to increase the visibility of a user, wherein said nozzle comprises a self-resonating nozzle configured to provide an interrupted stream of water.

25. A personal visibility marker comprising:

a housing including at least one intake opening, said housing configured to be coupled to a personal floatation device;

a pump coupled to said housing and fluidly coupled to said at least one intake opening;

a power supply configured to be coupled to said pump;

at least one nozzle fluidly coupled to said pump, said nozzle configured to expel a stream of water to increase the visibility of a user; and a control circuit configured to control power to said pump, wherein said control circuit is further configured to modulate power to said pump to provide an interrupted stream of water.

26. A personal visibility marker comprising:

a housing including at least one intake opening, said housing configured to be coupled to a personal floatation device;

a pump coupled to said housing and fluidly coupled to said at least one intake opening;

a power supply configured to be coupled to said pump;

at least one nozzle fluidly coupled to said pump, said nozzle configured to expel a stream of water to increase the visibility of a user; and at least one strap configured to removably couple said housing to said personal floatation device.

* * * * *

UNITED STATES PATENT AND TRADEMARK OFFICE

CERTIFICATE OF CORRECTION

PATENT NO. : 7,442,105 B2
APPLICATION NO. : 11/745054
DATED : October 28, 2008
INVENTOR(S) : Russell et al.

It is certified that error appears in the above-identified patent and that said Letters Patent is hereby corrected as shown below:

On the title page, in item (57), under "Abstract", in column 2, line 5, delete "removeably" and insert -- removably --, therefor.

In column 11, line 55, in Claim 11, delete "self resonating" and insert -- self-resonating --, therefor.

In column 12, line 65, in Claim 22, delete "user;" and insert -- user, --, therefor.

In column 12, line 66, in Claim 22, delete "in" and insert -- an --, therefor.

Signed and Sealed this

Twenty-sixth Day of May, 2009

JOHN DOLL
*Acting Director of the United States Patent and Trademark Office*